US006115899A

United States Patent [19]

Rider

[11] Patent Number: 6,115,899

[45] Date of Patent: Sep. 12, 2000

[54] ROOF SEAMING APPARATUS

[76] Inventor: Terry L. Rider, 303 Road 513, Corinth, Miss. 38834

[21] Appl. No.: 09/273,194

[22] Filed: Mar. 19, 1999

[51] Int. Cl.[7] ..... B23P 11/00

[52] U.S. Cl. ..... 29/243.5

[58] Field of Search ..... 29/243.5, 243.58, 29/293.57; 72/48, 121, DIG. 1, 210, 298

[56] References Cited

U.S. PATENT DOCUMENTS

| | | | |
|---|---|---|---|
| 3,662,699 | 5/1972 | Horn et al. | 29/243.5 |
| 4,324,031 | 4/1982 | Isenhoff | 29/243.58 |
| 4,372,022 | 2/1983 | Puckett | 29/243.58 |
| 4,470,186 | 9/1984 | Knudson | 29/243.5 |
| 4,726,107 | 2/1988 | Knudson | 29/243.5 |
| 4,918,797 | 4/1990 | Watkins et al. | 29/243.5 |
| 4,989,308 | 2/1991 | Sanders | 29/243.5 |
| 5,604,966 | 2/1997 | Morello et al. | 29/243.58 |
| 5,623,805 | 4/1997 | Morello . | |

*Primary Examiner*—Robert C. Watson
*Attorney, Agent, or Firm*—Garvey, Smith, Nehrbass & Doody, LLC

[57] ABSTRACT

A roof seaming apparatus for seaming a metal roof provides a frame having opposed upper and lower roller groups that can selectively engage and seam the roof panels depending upon orientation of the frame. When seaming a roof, the machine lower rollers engage the roof seam at the eave of the roof. The machine is powered so that the upper rollers from the seam as the machine travels to the roof crest. At the crest, the machine is inverted so that the upper rollers engage and form the seam from the crest to the opposite eave.

19 Claims, 10 Drawing Sheets

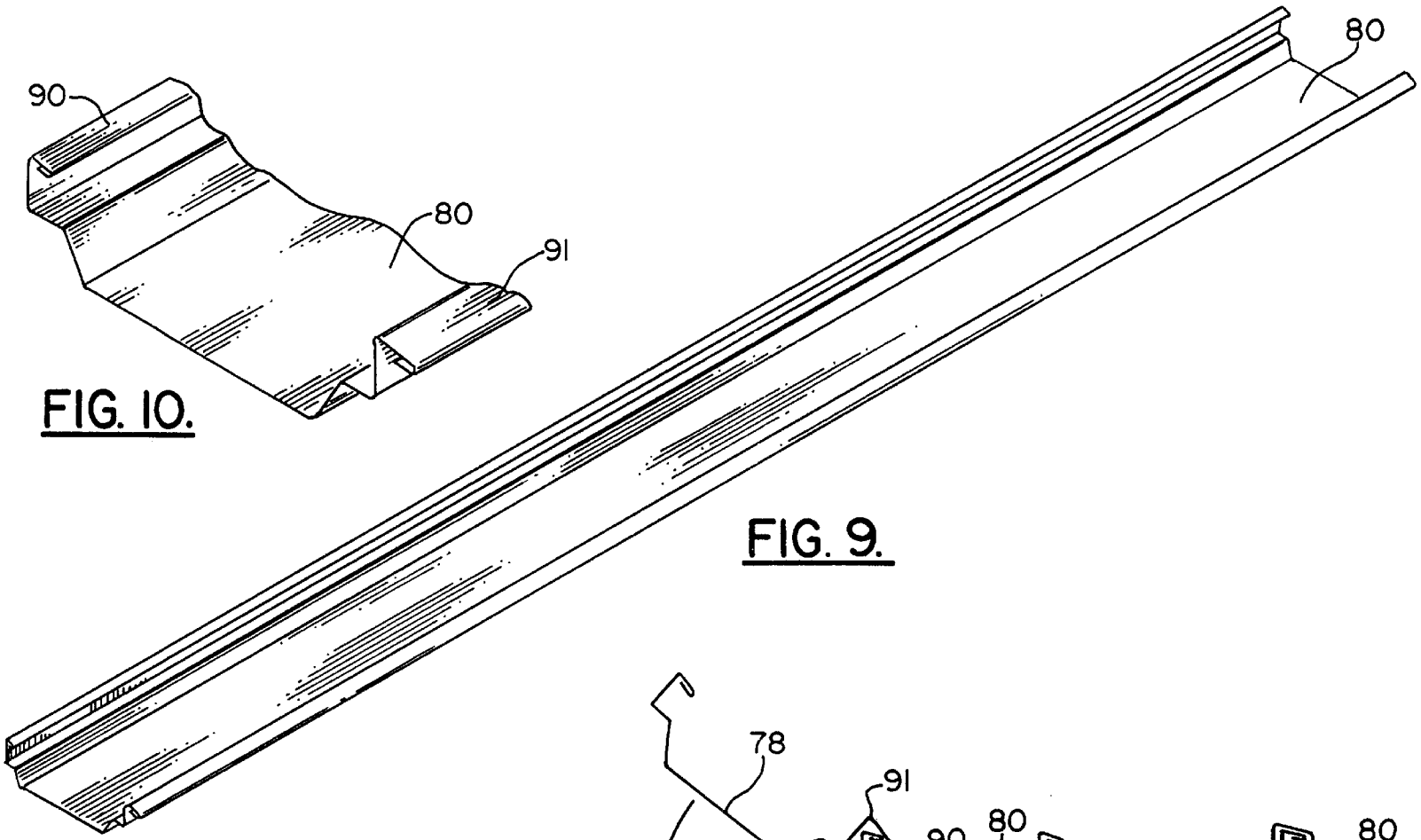
FIG. 9.
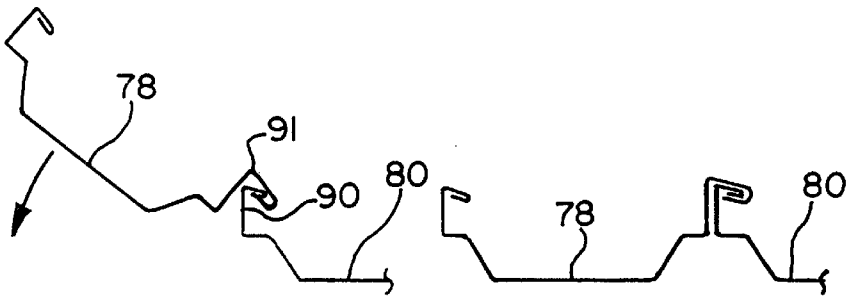
FIG. IIA.
FIG. IIB.
FIG. IO.

ROOF SEAMING APPARATUS

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to the construction of roofs, and more particularly the construction of metal roofs. More particularly, the present invention relates to an improved roof seaming apparatus that is capable of seaming a roof without reversing the direction of the motor or the gearing, direction thus reducing excessive wear to the drive system. The apparatus includes a machine frame having two sets of forming rollers respectively at the upper portion of the machine frame and at the lower position of the machine frame. A drive rotates each set of rollers so that the operator can invert the machine when it reaches the roof crest, and thus continue operation down the next roof seam of the roof.

2. General Background of the Invention

The evolution of roof seaming machines has produced a number of commercially available machines that start at the eave of the roof and seam upward toward the crest. However, with prior art type machines, an operator is required to carry the machine down to the eave of the roof in order to seam the next adjacent panel.

An early metal roof seaming machine is disclosed in U.S. Pat. No. 3,662,699 issued to Leo Horn et al. The Horn '699 patent discloses a machine for forming a standing seam on heavy gauge metal roof panels having upstanding, opposite margins terminating upwardly with a preformed partially closed interlocking portion being bent so as to be substantially parallel with the plane of the panel. The machine includes a pair of rollers horizontally disposed axially, being rotatably attached to the forward end of the machine and arranged so as to straddle the interlocked portion of two adjacent panels for: (1) closing the interlocked portions; (2) foldably urging the interlocked portions of the panels downwardly so as to start forming the standing seam; (3) clampingly securing the front of the machine to the panels. The machine also includes a plurality of vertically disposed pairs of rollers, each succeeding pair further folding the interlocked portions of the panels downwardly so that the final pair finishes forming the standing seam. Additionally, certain of these rollers include flanges suitably arranged to engage the interlocked portions of the panels so that the rearward end of the machine is held firmly against the metal as it is being folded.

The Isenhoff patent U.S. Pat. No. 4,324,031 discloses a seaming machine for securing a batten to a roof rib which includes a housing (24) having two longitudinal sections (25, 29) which are pivotably secured together about a vertical axis. A cam locking arrangement is provided at the rear of the housings to lock the housing sections (25, 29) together when the machine is positioned on a roof rib. The cam locking arrangement includes a pair of vertically spaced cams (102, 104) which engage a pin (50) disposed in one of the housing sections (25). The seaming machine comprises three pairs of horizontally disposed rollers (52, 54, 56) which progressively bend a flange on a batten against a roof rib, with the rollers engaging the sides of the roof rib to drive the machine along the rib. Vertical pinch rollers (76) are provided between the second and third stage horizontal rollers (54, 56) to crimp the flange on the batten against the roof rib. In this way, a secure and waterproof connection of the batten to the roof rib is provided.

In the Pucket patent U.S. Pat. No. 4,372,022, there is disclosed a seaming machine that has two pairs of dies which are longitudinally spaced. The dies are mounted from a frame for pivoting movement about parallel axes equally spaced on opposite sides of the longitudinal center line of the machine. A motor supported by the frame drives an eccentric and associated linkage which cause the dies to swing or oscillate laterally about said axes. The machine includes rollers adapting the machine for movement along metal roof panels of the type having their longitudinal edges configured for defining a stand rib seam. A sealing cap fits over the adjoining edges of the roof panels which form the standing rib. As the machine moves astride the cap, the dies engage and deform the sealing cap and also interlock the roof panels.

A reversible seaming apparatus with laterally separable rollers having parallel axes is disclosed in U.S. Pat. No. 4,470,186 issued to Gary Knudson. The Knudson patent discloses a seaming apparatus that has two sets of opposed seaming rollers (21, 22 and 23, 24) rotatably mounted on a base (20) and positioned so that the sets successively engage and track on opposite side edge portions of the panel and bend a terminal side section (17) under to form a continuous seam. A drive motor (111) and drive train (81, 82, 83, 84, 113) between the motor and rollers provides a direct positive drive for each roller. One roller of each set is mounted on a slidable base portion (27) that provides for varying the roller spacing and is removable from a main base (26) and reinsertable thereinto along the opposite side to reverse roller positions. Modified forms of seaming apparatus have two spaced slide bores (335) in blocks (333) sandwiched between spaced plates (331, 332) with thrust pins 341 slidable in the bores for guided movement of two base portions (326, 327). A dual clevis (370) on a single actuator arm (363) and detents (382) on the inboard base portion with springs (350) between the base portions move and lock the base portions. Pin (401) and slot (402) couplings are disclosed for interchanging the outboard rollers or a duplicate set of leading rollers (531 and 532) is used on the opposite ends of the base portions for reversing the direction of the seaming apparatus.

U.S. Pat. No. 4,726,107 issued to Gary Knudson discloses a seaming apparatus for joining the adjacent side edge portions of two adjacent panels to provide a continuous seam. The apparatus includes a support base having a main base portion and a movable base portion. The movable base portion is pivotally connected to the main base portion for pivotal movement about an axis between a first position and a second position. Sets of opposed motor driven seaming rollers are mounted on the base with one roller of each set being rotatably mounted on the movable base portion and the other roller of each set rotatably mounted on the main base portion. The rollers of each set are oppositely disposed and have peripheral surfaces arranged to engage the adjacent side edge portions of the adjacent panels. A drive train driven by a motor and including a drive gear for each driven roller is provided for rotating the driven rollers to move the apparatus along the adjacent side edge portions. Actuating means is mounted off one side of the movable base portion for pivotally moving the movable base toward and away from the main base between the first position and the second position. When in the first position, the axes of the rollers of each set of driven rollers will be substantially parallel. When in the second position, these axes will form an included angle of less than 30 degrees which maintains the drive gears of each set of rollers in meshing engagement. One seamer has four sets and the other three sets of seaming rollers. The latter form uses a cam surface to direct one of the rollers of one set in a selected path to move the roller to a horizontal position and to clear the formed seam.

This new machine is directed to fact that rollers are on top and bottom so that machine is turned upside down to go from one seam to the next. (See page 5 lines 27+).

The Neil Watkins patent U.S. Pat. No. 4,918,797 discloses a metal roof panel seaming apparatus which includes a main body portion that can be rolled along an unformed or partially formed seam, the body portion including a plurality of adjacent pairs of rollers, positioned along the underside of the body portion, one set of the rollers independent movable from a first position cammed away from the partially or unformed seam, to a second position cammed into the seam, for undertaking the seaming process. The second roll of rollers are stationary in position, and serve as drive rollers along the opposite side of the unformed or partially formed seam as the seam is crimped between the various pairs of rollers during the seaming process. There is further included, that the plurality of the two rolls of rollers provide a means for allowing the apparatus to move bi-directional and the ability to undertake the seaming process in either direction. The apparatus is able to undertake seaming in either direction along the roof panel and the seaming process may be initiated at any point along the length of the panel upon camming the rollers into position to undertake the seaming process.

A bidirectional roof seaming machine is disclosed in U.S. Pat. No. 4,989,308. The '308 patent provides a roof seaming machine that has symmetrically arranged forming rolls and a reversible permanent magnet motor for operation of the machine in either a forward or reverse direction. An adjustable linkage connects the forming rolls with an articulated handle for moving the forming rolls relative to a drive wheel which propels the machine and which is adapted to be disposed on the opposite of a seam from the forming rolls. A reversible switch is connected to energize and de-energized the motor, and a directional switch safety guard is associated with the switch to limit its movement between an "off" position and either one or two "on" positions, depending upon the positioning of the guard.

The Morello patent U.S. Pat. No. 5,604,966 discloses a seaming device for connecting building panels in a continuous along adjacent side edges of two building panels in the construction of a building or light structure which is particularly suited for seaming panels with both curved and straight portions. The seaming device includes a first frame having an electric motor and two horizontally opposed rollers and a second portion having an electric motor and two horizontally opposed rollers with the first and second portions being coupled together in a hinge-like manner.

In the Morello patent U.S. Pat. No. 5,623,805, there is disclosed a seaming device for connecting building panels in a continuous seam along adjacent side edges of two building panels in the construction of a building or like structure which is particularly suited for seaming panels with both curved and straight portions. The seaming device includes an intermediate set of rollers capable of moving vertically and thereby allowing the seamer to seam panels having both straight portions and curved portions. By allowing the intermediate rollers to move vertically, the seaming apparatus of the present invention "walks" along the panel much more easily and avoids causing damage to the paint of the panel. The vertical movement of the intermediate rollers permits the seamer to adjust to changes in the panel from straight to curved and curved to straight.

These prior art references do not disclose the concept of a roof seaming machine that has a frame with upper and lower rollers that enable either the upper set of rollers or the lower set of rollers to engage the seam during use. This construction enables the machine to be rotated 180 degrees so that the lower rollers initially engage the seam from eave to crest. When the machine reaches the crest of the roof, it is then inverted so that the upper rollers now engage the seam as the machine moves downwardly from crest to eave on the next adjacent seam. The same cam both unlocks one set of rollers (eg. upper) and locks the other set of rollers (eg. lower).

BRIEF SUMMARY OF THE INVENTION

The present provides an improved apparatus for forming the seam that joins two adjacent interlocking metal roof sections.

The apparatus includes a frame having opposed upper and lower portions.

The upper and lower portion of the frame each provide a plurality of forming rollers. These rollers enable the frame to be frictionally engaged with each of the roof sections at the seam. Either an upper set of rollers at the upper portion of the frame, or a lower set of rollers at the lower portion of the frame can be used to engage the seam during forming.

A cam locking mechanism is provided for closing a selected set of rollers (i.e. either the upper rollers or the lower rollers) to grip the seam such as at the eave of the roof when seaming is initiated.

A motor drive is provided for rotating at least some of the rollers for transporting the frame along the roof seam during the forming operation.

The upper and lower rollers can be selected to engage the roof seam by orienting the frame to present the selected upper or lower rollers to the roof seam.

The present invention thus has utility in seaming a roof beginning at the eave on one side of the roof, progressing up the seam to the crest of the roof, and then by inverting the machine, it can continue operation seaming from the crest downwardly toward the opposing eave.

The apparatus includes a locking mechanism that preferably opens one set of rollers while simultaneously closing the other set of rollers.

Each set of (i.e. upper and lower) rollers include opposed rollers that move toward and away from each other as the rollers are opened or closed.

The present invention provides an improved method of roofing a building that includes the placing of a plurality of metal roof panels on the building and interlocking adjacent roof panels to form a seam.

As part of the method, the apparatus of the present invention provides a frame that is placed on the seam, the machine frame including upper and lower rollers that can be selected to engage the roof seam by orienting the frame to present the selected upper or lowers to the roof seam.

A plurality of the roof seams can be formed or crimped by alternatively presenting the upper rollers to a first seam (such as from the roof eave to the roof crest) between a first pair of panels. The lower rollers are then presented to a second seam (such as from the roof crest to the roof eave) between a second pair of panels.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein:

FIG. 9 is a fragmentary perspective view showing a typical roof section;

FIG. 10 is a partial perspective view showing typical roof sections;

FIGS. 11A and 11B are end views showing typical roof sections;

DETAILED DESCRIPTION OF THE INVENTION

Figure 1:
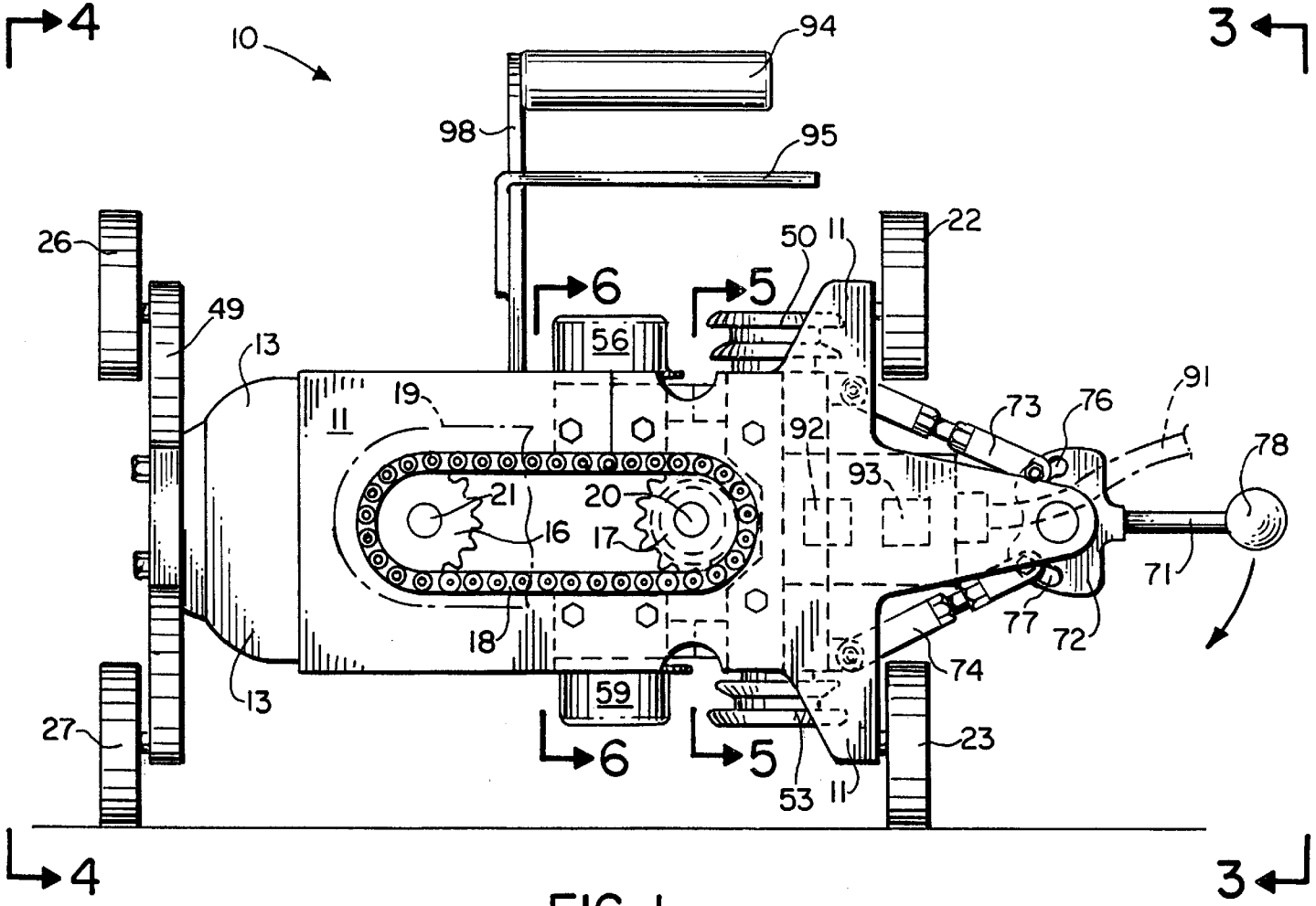
FIG. 1 is a front elevational view of the preferred embodiment of the apparatus of the present invention.

In FIGS. 1–4, roof seaming apparatus 10 has a chassis that is formed of front plate 11, rear plate 12, motor drive 13, side plates 14, 15 and middle wheel plate 49. The motor drive is equipped with a motor sprocket 16 that engages a chain 18. The chain 18 also drives shaft sprocket 17 that is connected to an end portion of shaft 21. When the motor drive 13 is operated, it rotates worm gear shaft 20. The worm gear shaft 20 includes three worm gears 62, 63, 64. The worm gears 62, 63, 64 drive other gears that rotate the seaming rollers to crimp or seam the roof seam.

Chain guard 19 can be used to protectively surround motor sprocket 16, shaft sprocket 17, and chain 18. Motor sprocket 16 is mounted on motor shaft 61 which rotates in one direction so that the motor drive 13, sprocket 16 and sprocket 17 always rotate together.

Figure 13:
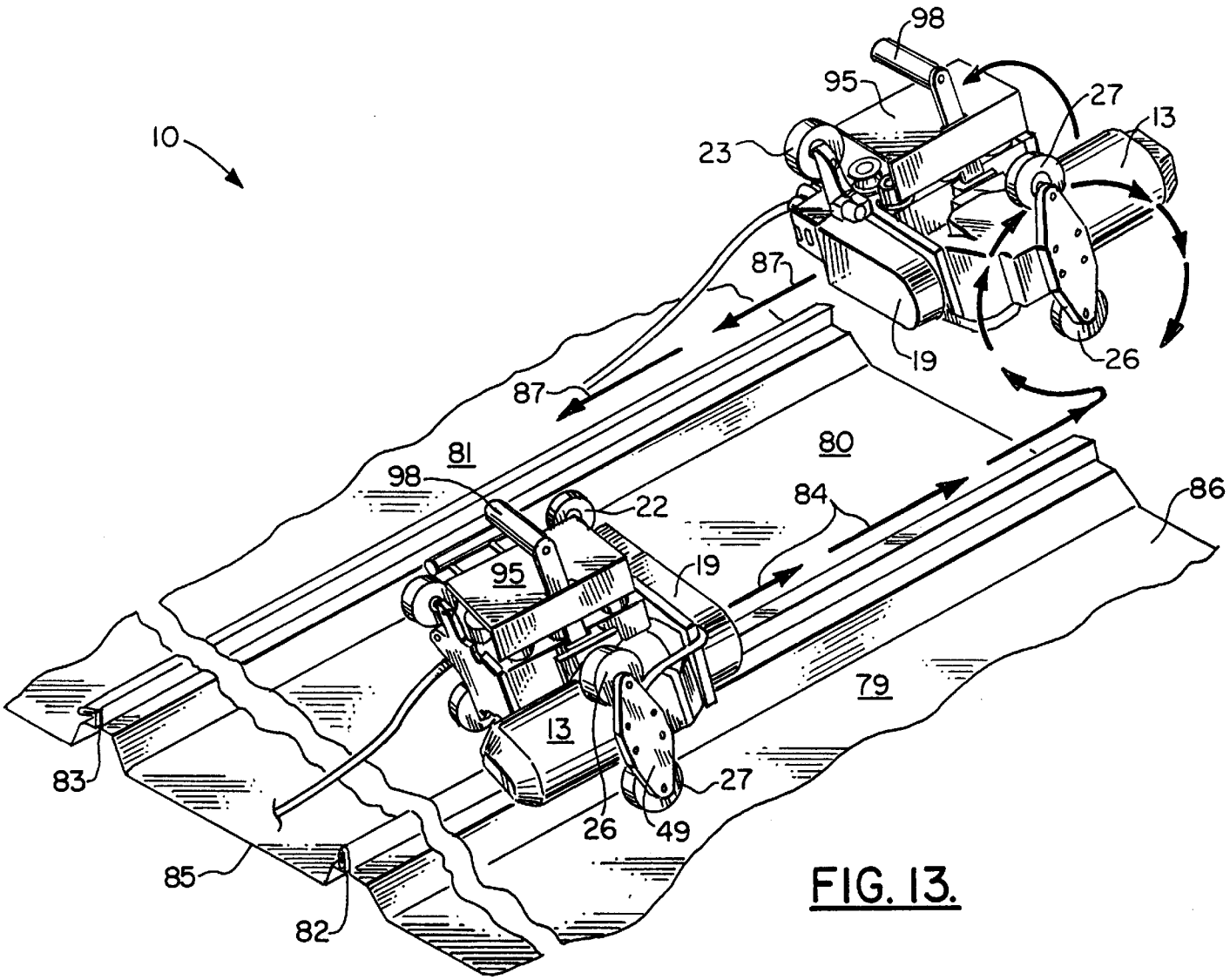
FIG. 13 is a perspective view illustrating the method of the present invention.

A plurality of wheels enable the apparatus 10 to track upon a roof during a seaming operation. In FIG. 13, the roof panels can include a plurality of roof panels (e.g. 10, 20, 30, etc.) positioned side by side. For purposes of illustration, in FIG. 13 there are three roof panels illustrating to simplify the drawing including first roof panel 79, a second roof panel 80, and a third roof panel 81. The center roof panel 80 connects with each of the roof panels 79 and 81 respectively at seams 82, 83. During use, the apparatus 10 proceeds along a path indicated by arrows 84 in FIG. 13 from the eave 85 of the roof to the crest 86. The user then flips the apparatus 10 over after it seams the first seam 82 and places it on the second seam 83. The apparatus 10 travels in the same direction (indicated by arrow 100 in FIG. 4) in each case, the front of the machine being at guard 19. Thus, the apparatus 10 can move from eave 85 to crest 86 and then from crest 86 to eave 85. This return path of the apparatus 10 from crest 86 to eave 85 is indicated by the arrows 87 in FIG. 13.

A plurality of wheels and rollers support the apparatus 10 as it moves along a roof seam 82 or 83. The wheels include an upper set of three wheels and a lower set of three wheels. The upper wheels include upper front wheel 22, upper rear wheel 24, and upper middle wheel 26. The lower set of wheels include lower front wheel 23, lower rear wheel 25, and lower middle wheel 27. During use, these sets of wheels are alternatively used to engage the roof panels 79, 80, 81 as the apparatus 10 moves along a selected seam 82, 83. The wheels 22–27 are idler wheels that engage roof panels 79 and 80 or 81 and 81. The apparatus 10 is propelled by a plurality of rollers that engage and crimp a selected seam 82 or 83.

Figure 4:
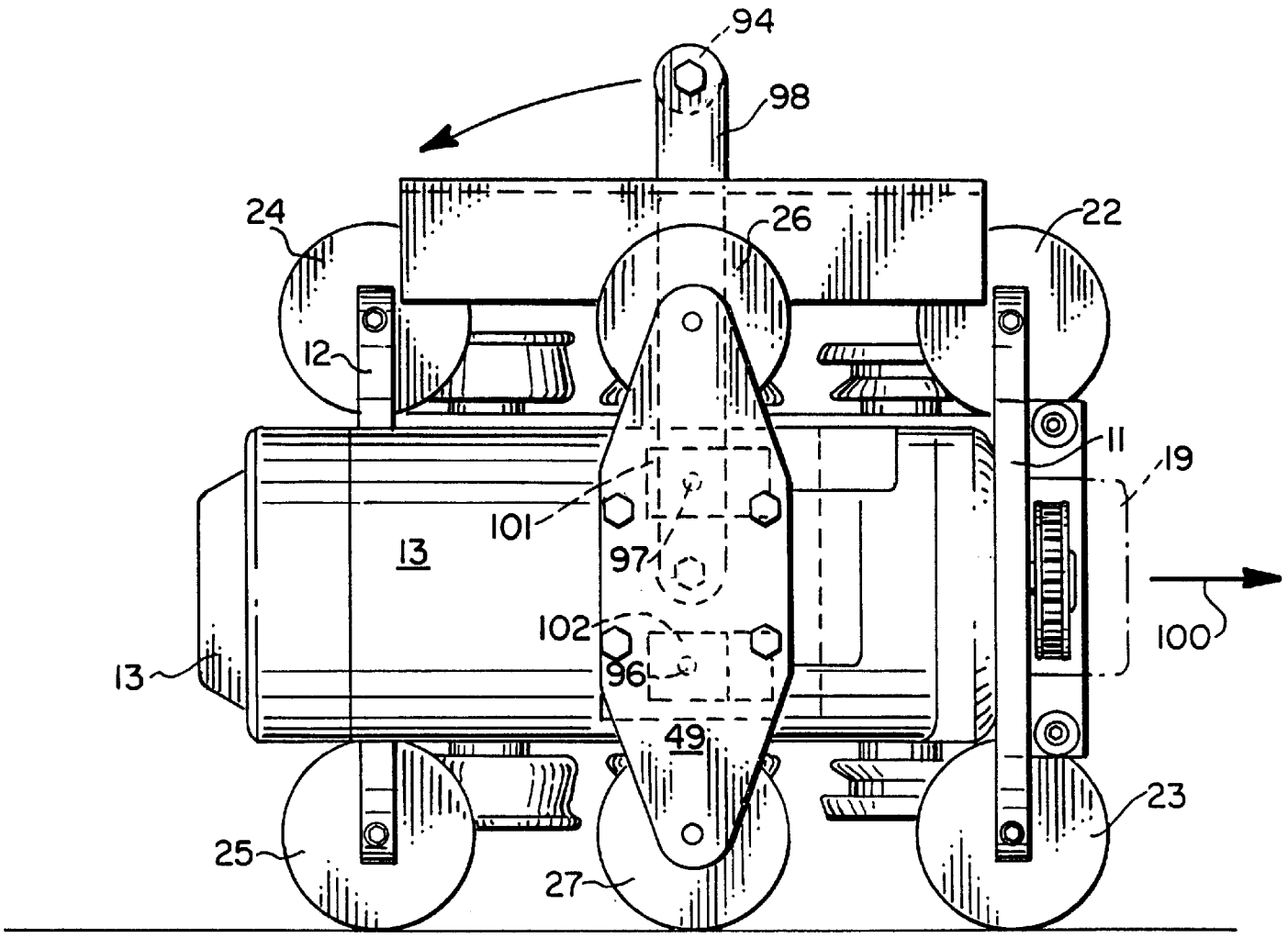
FIG. 4 is another side view of the preferred embodiment of the apparatus of the present invention taken along lines 4—4 of FIG. 1.
Figure 5:
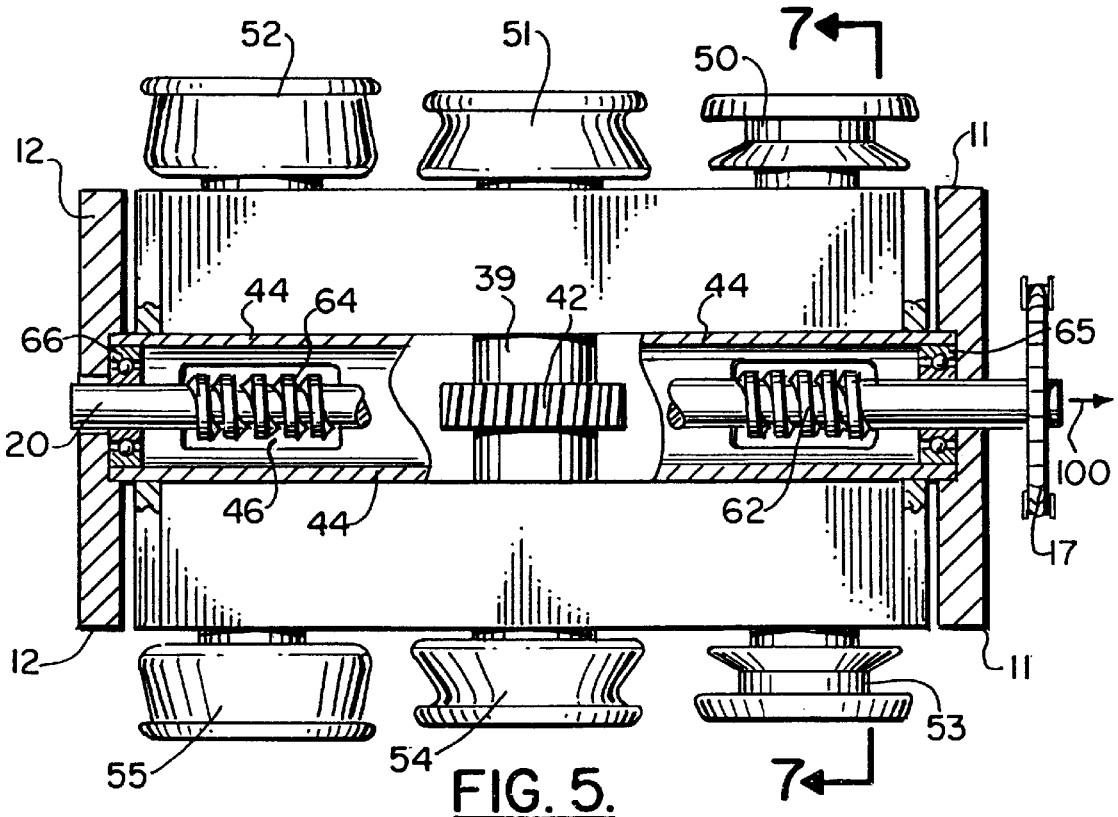
FIG. 5 is a sectional view taken along lines 5—5 of FIG. 1.
Figure 6:
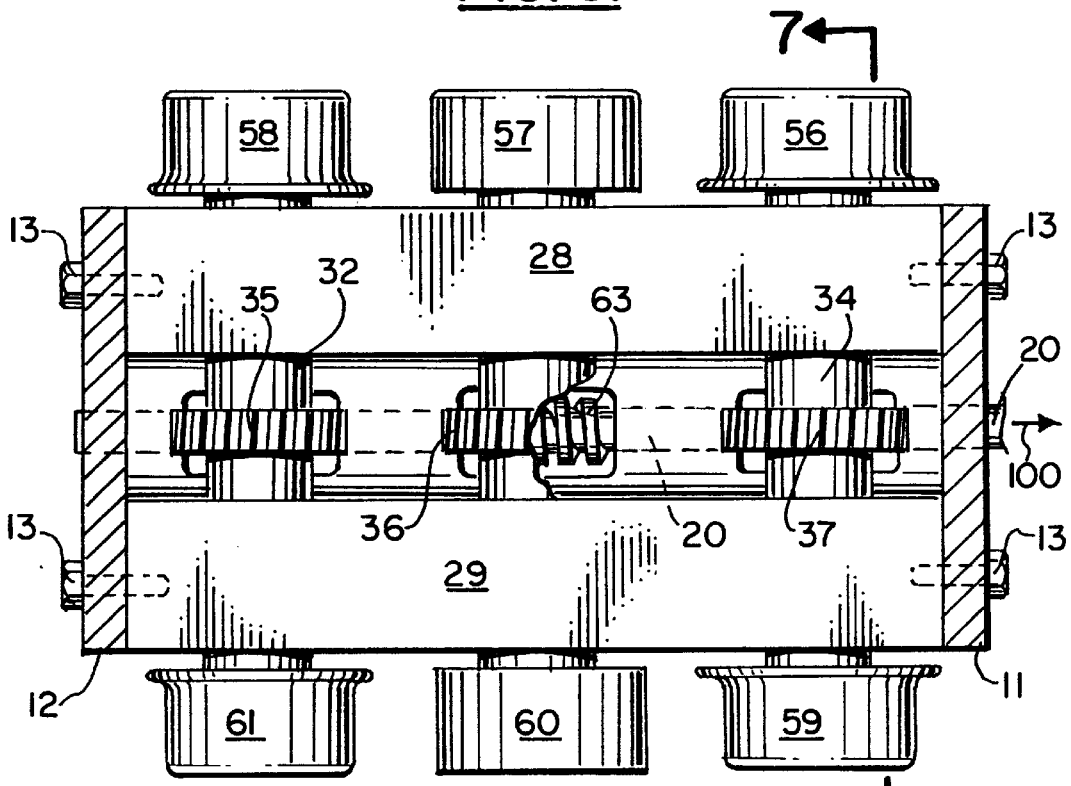
FIG. 6 is a sectional view taken along lines 6—6 of FIG. 1.

The rollers are driven by motor 13 using a gear arrangement that will be described more fully hereinafter. In the preferred embodiment, the rollers include six upper rollers and six lower rollers. As best seen in FIGS. 3–6, the upper rollers include upper primary seaming roller 50, upper secondary seaming roller 51, and upper final seaming roller 52. In an opposed position to these upper seaming rollers 50, 51, 52, there are upper fixed rollers 56, 57, 58. The upper rollers include upper primary roller 56, upper secondary roller 57, and upper final roller 58. A lower set of fixed rollers are opposed to and work in concert with the lower seaming rollers 53, 54, 55. As shown in FIGS. 5 and 6, the lower fixed rollers include lower primary fixed roller 59, lower secondary roller 60 and lower final roller 61.

The gear arrangement that powers the rollers 50–59 can best be seen in FIGS. 5–8. Additionally, a cam locking arrangement that is best seen in FIG. 1, 2, 3, 4, 7, 12A–12D selectively locks either the upper plurality of rollers 50, 51, 52, 56, 57, 58 to a selected seam 82 or 83 or in the alternative, the cam locking arrangement locks the lower plurality of rollers including rollers 53, 54, 55, 59, 60, 61 to a selected seam 82 or 83. During use, the lower set of rollers first engages seam 82 as shown in FIG. 13. After a first seam has been completed by the apparatus 10 as it moves from eave 85 to crest 86, the apparatus 10 is then inverted so that the upper set of rollers now grip the seam 83 during seaming operations that begin at crest 86 and terminate at eave 85.

Figure 8:
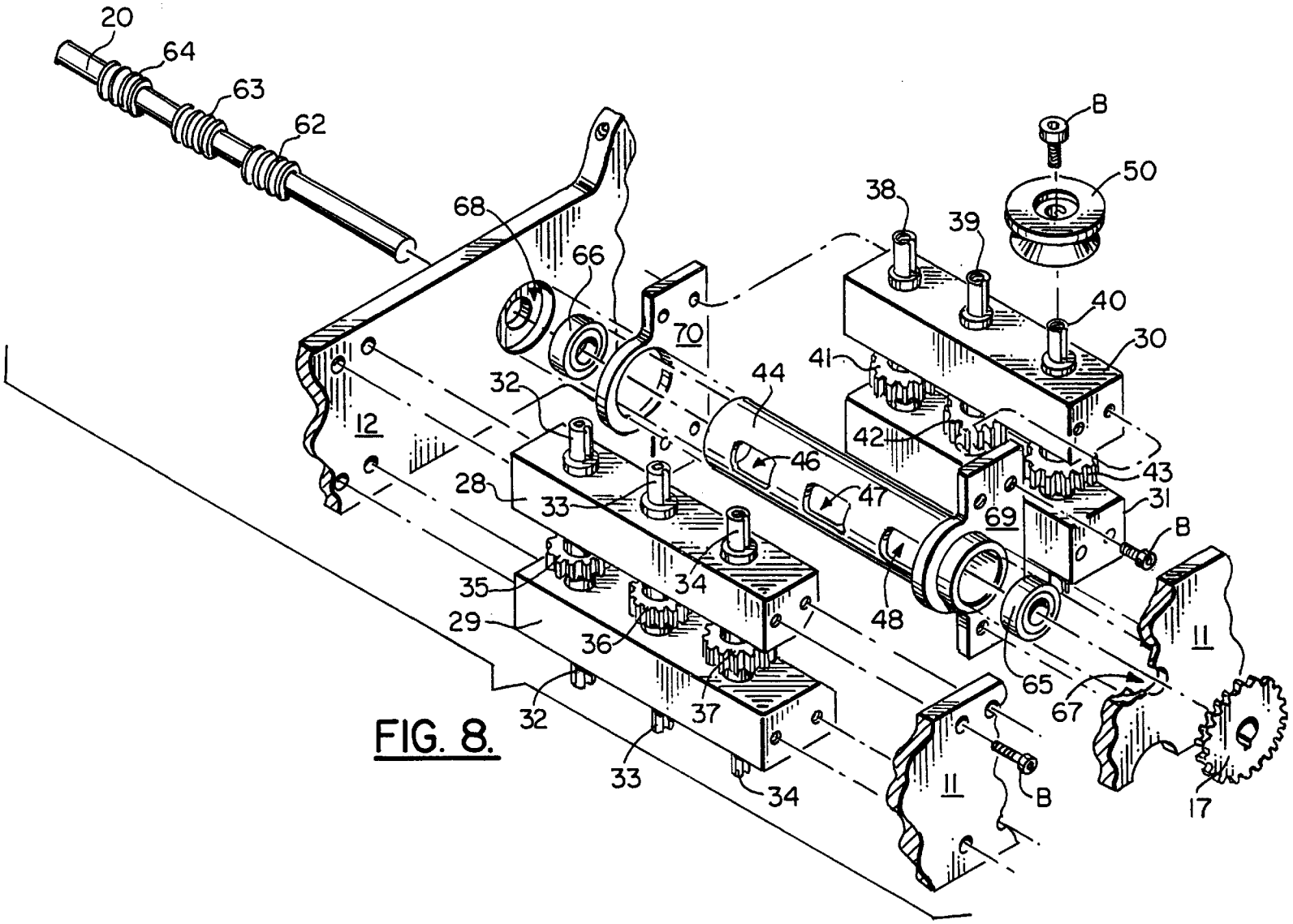
FIG. 8 is a fragmentary, exploded view of the preferred embodiment of the apparatus of the present invention showing the gears and rollers.

In FIG. 8, upper fixed gear support 28 and lower fixed gear support 29 are shown bolted in a fixed position to front plate 11 and rear plate 12 using a plurality of bolted connections B, for example. These fixed gear supports 28, 29 carry rollers 56–58 and 59–61 as shown in FIG. 6. A plurality of gear shafts 32, 33, 34 extend through the upper and lower supports 28, 29 as shown in FIG. 8. The shaft 32 carries gear 35 in between supports 29 and 30. Similarly, the gear 37 is carried on shaft 33 and the gear 37 on shaft 34. The respective rollers 56–58 are mounted on shafts 34, 33 and 32. The respective lower fixed rollers 59–61 are mounted respectively on the shafts 34, 33, 32.

Figure 2:
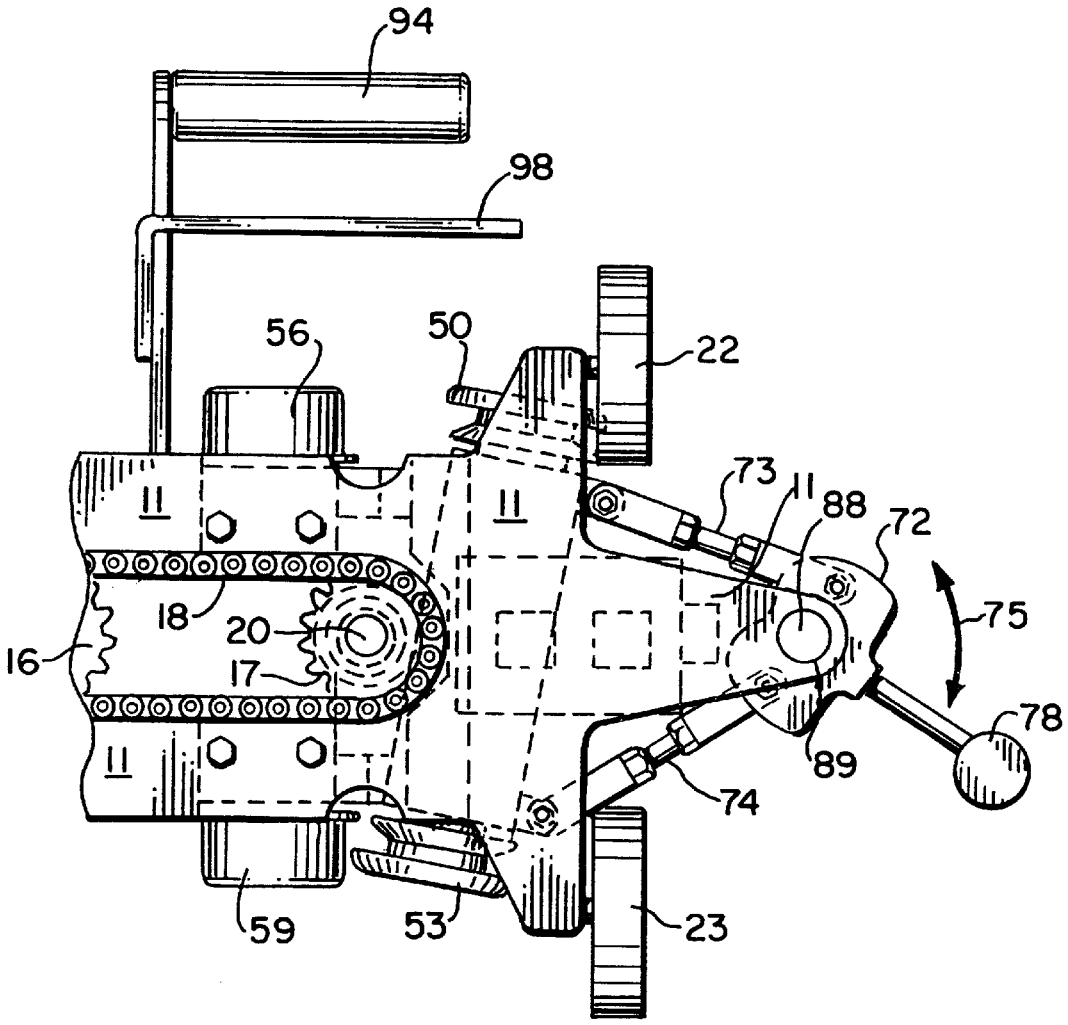
FIG. 2 is a partial front view of the preferred embodiment of the apparatus of the present invention showing the cam handle in motion.
Figure 3:
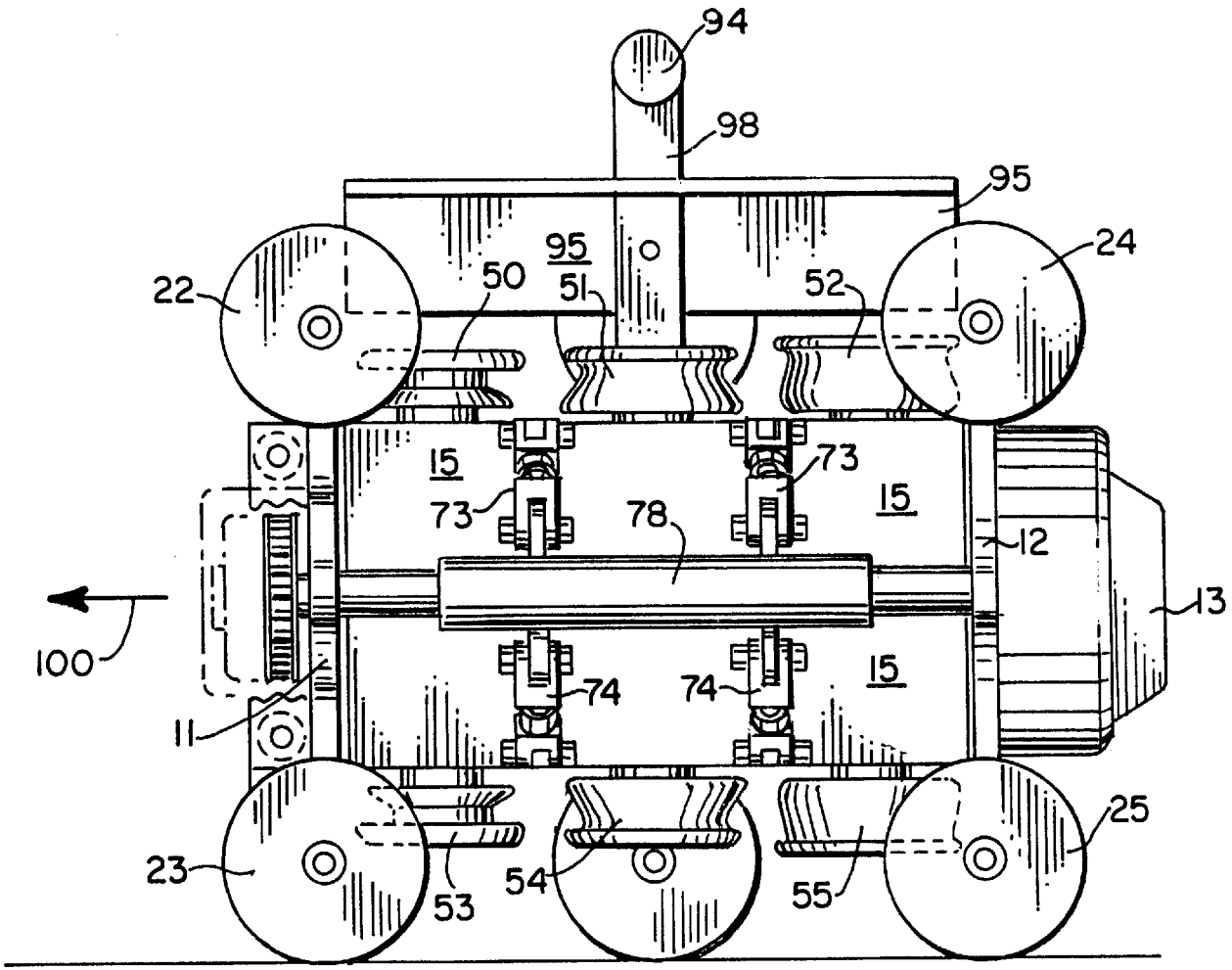
FIG. 3 is a side view of the preferred embodiment of the apparatus of the present invention taken along lines 3—3 of FIG. 1.

A second pair of supports 30, 31 are pivoting supports that move in a pivoting fashion when actuated by cam handle 78 and cam lever 71. The user moves the cam handle 78 in the direction of arrow 75 in FIG. 2 in a back and forth pivoting fashion to alternatively lock either the top set of rollers 50, 51, 52 into close engagement with the top set of fixed rollers 56, 57, 58 or the bottom set of pivoting rollers 53, 54, 55 into close proximity with fixed rollers 59, 60, 61. In FIG. 2 for example, the lower seaming rollers 53, 54, 55 have been moved into close engagement with the lower fixed rollers 59, 60, 61 during a seaming of a roof seam 82 or 83 when the lower set of rollers are performing the seaming operation.

The supports 30, 31 include an upper pivoting gear support 30 and a lower pivoting gear support 31. As with the fixed supports 28, 29, there are three shafts 38, 39, 40 that extend between supports 30, 31. The shaft 30 carries a gear 41 in between supports 30, 31. Similarly, the shaft 39 carries a gear 42 in between supports 30, 31. Gear 43 is carried on shaft 40 in between supports 30 and 31. A bolted connection B can be used to attach each roller 50–61 to its shaft 32–34 or 38–40.

Upper and lower supports 30, 31 pivot about sleeve 44 through a pair of bearing plates 69, 70. The upper and lower 30, 31 supports are bolted for example to plates 69, 70 using bolted connections B. Sleeve 44 fits cylindrically shaped sockets 67, 68 that are respectively on front plate 11 and rear plate 12. Sleeve 44 is hollow providing an open ended sleeve bore 45. A rotary bearing 65, 66 is provided for placement in each end of sleeve bore 45. The bearings 65, 66 support shaft 20. In this fashion, the shaft 20 can rotate, being powered by its sprocket 17 that is driven by chain 18, motor sprocket 16, and motor drive 13. The sleeve 44 is fixed to end plates 11, 12, being press fit or interference fit into sockets 67 and 68. The bearing plates 69 and 70 rotate upon the outer surface of sleeve 44. In this fashion, the assembly of upper pivoting gear support 30, lower pivoting gear support 31, shafts 38–40, gears 41–43, and the connected rollers 50–52 and 53–55 all pivot with plates 69, 70 about sleeve 44 when cam handle 78 is rotated as shown by arrow 75.

A plurality of openings 46–48 in sleeve 44 enable the worm gears 62, 63, 64 to enter mesh with gears 35–37 and, at the same time, with gears 41–43. The worm gears 62, 63, 64 and the gears 35–37 and 41–43 are so configured that when the motor drive 13 rotates sprocket 17 and shaft 20, the selected upper rollers 50–52 and 56–58 propel the apparatus forward in the direction of arrow 84 or 87 when the upper rollers engage a seam 82 or 83. Similarly, when the machine 10 is flipped over, the rotation of shaft 20 and gears 35–37 and gears 41–43 enable the lower rollers 53–55 and 59–61 to propel the apparatus 10 in a forward direction as indicated by arrows 84 or 87. The front of the machine is defined by chain guard 19 as shown in FIG. 13 with respect to the direction of travel of the apparatus 10.

Figure 7:
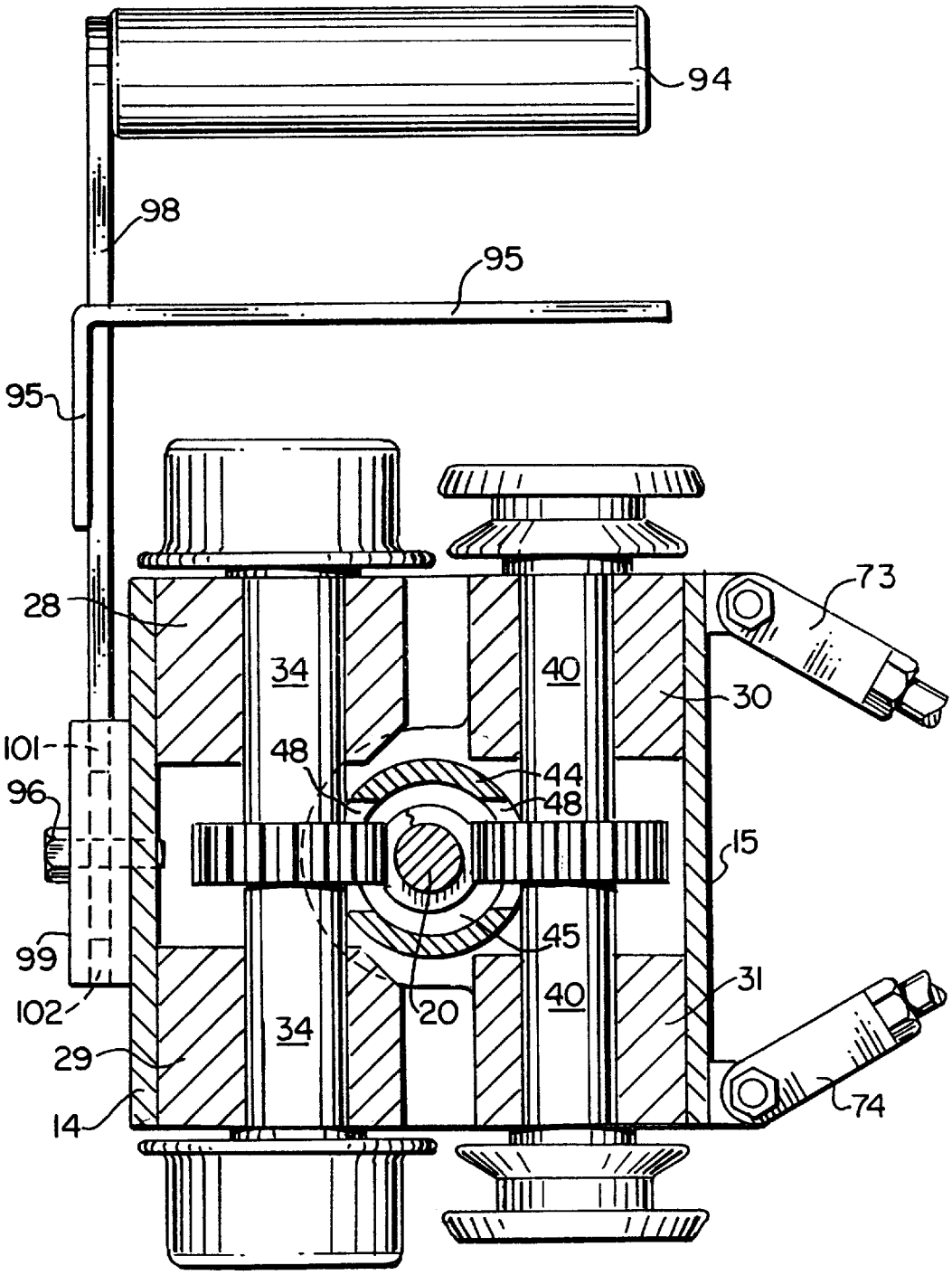
FIG. 7 is a sectional view taken along lines 7—7 of FIG. 5 or FIG. 6.

The cam locking arrangement that locks either the upper rollers 50–52 or the lower rollers 53–54 into engagement with a plurality of the fixed rollers 56–58 or 59–61 is best seen in FIGS. 1, 2 and 7. The cam locking arrangement includes a cam lever 71 that can be operated with handle 78. An upper link 73 extends between cam 72 and the assembly of upper and lower pivoting gear supports 30, 31. In FIG. 7, these links 73 and 74 can be attached for example by welding, bolting or the like to side plate 15 that is bolted to upper and lower pivoting gear supports 30, 31. Cam 72 rotates about cam shaft 88 that is mounted between end plates 11, 12. The cam 72 has a central opening 89 that fits shaft 88. The cam 72 also has a pair of arcuate, curved slots 76, 77 that are bolted to an end portion of each link 73, 74 as shown in FIGS. 1 and 2. In FIG. 2, the cam handle 78 has been rotated to a lower most position that causes the cam 72 to push link 74 inwardly toward the fixed lower rollers 59–61. The lower rollers 53–55 and 59–61 are now in position to properly seam the roof as indicated more specifically in FIGS. 9–10, 11A–11B and 12A–12B. FIG. 10 shows a typical roof panel 80 having a male flange 90 and a female flange 91. In FIG. 11A, a roof panel 81 is shown being preliminarily joined to a roof panel 80 before the seaming operation is initiated. In FIG. 11B, the panels 79, 80 are shown in the typical position that the panels 78, 80 assume just prior to a reforming of the seam 83 or 84 using the apparatus 10 of the present invention.

The apparatus 10 can be lifted with handle 94 for transport or during an invert of the apparatus 10 such as when a new seam is to be engaged with a different (i.e. upper or lower) set of rollers. Handle 94 attaches to side plate 14 at pivot 96 (see FIGS. 4 and 7). Handle 94 is mounted to arm 98. Arm 98 also carries guard 95 that it covers the set of rollers (upper or lower) not in use. A detent lock 97 can affix handle 94 in an upper position when the lower rollers 53–55 and 59–61 engage a seam and in a lower position (where arm 98 rotates 180 degrees about pivot 96) when the upper rollers 50–52 and 56–58 engage a seam. In FIGS. 4 and 7, handle bracket 99 has stop plates 101, 102 that limit movement of arm 98 in upper (FIG. 4) and lower positions. In FIG. 13, arm 98 is in the upper position on seam 82 and in the lower position just prior to placement on seam 83.

Figure 12A:
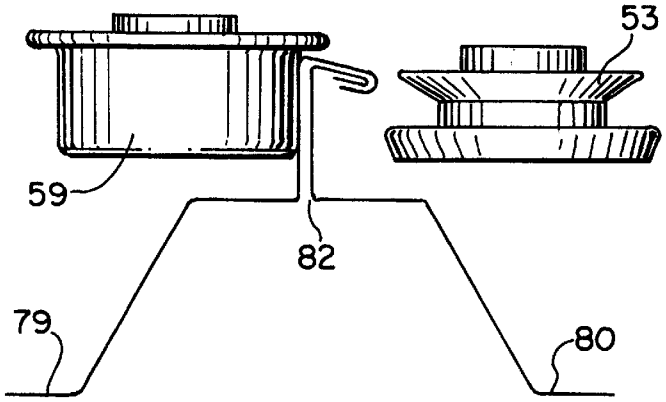
FIGS. 12A, 12B, 12C, 12D are schematic, fragmentary views of the preferred embodiment of the apparatus of the present invention showing the method of forming with rollers during seaming.
Figure 12B:
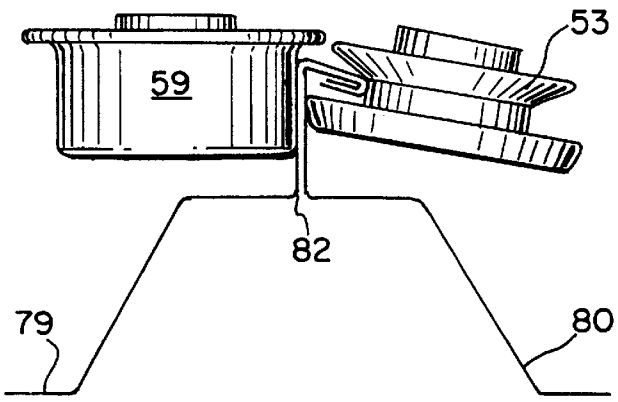
Figure 12C:
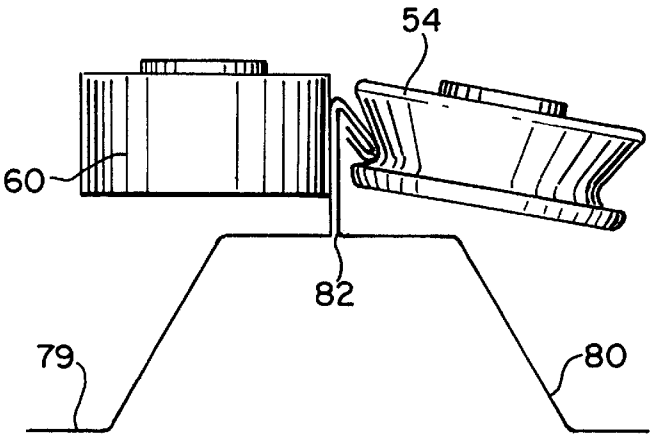
Figure 12D:
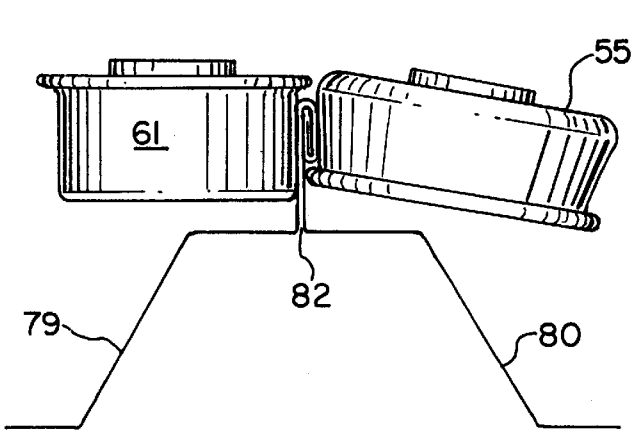

FIGS. 12A–12D show schematically the method of the present invention of seaming a roof using the lower seaming rollers 53–55 and the lower fixed rollers 59–61. In FIG. 12A, the lower primary seaming roller 53 is shown before it is pivoted into operating position using cam handle 78. In FIG. 12B, the lower primary seaming roller 53 has been engaged with seam 82 and is next to lower primary fixed roller 59. FIG. 12C illustrates the position of the seam 82 when it has been engaged by the secondary lower seaming roller 54 and its opposed lower secondary fixed roller 60. In FIG. 12D, the seaming operation has been completed by final lower seaming roller 55 and its lower final fixed roller 61. The upper rollers operate in like fashion when the apparatus 10 is flipped over to engage the next seam.

The apparatus 10 can be powered with an electrical power cable 91 and actuated using button switches 92 and 93 to turn the apparatus 10 on and off respectively.

PARTS LIST

The following is a list of suitable parts and materials for the various elements of the preferred embodiment of the present invention.

| PARTS LIST | |
|---|---|
| 10 | roof seaming apparatus |
| 11 | front plate |
| 12 | rear plate |
| 13 | motor drive |
| 14 | side plate |
| 15 | side plate |
| 16 | motor sprocket |
| 17 | shaft sprocket |
| 18 | chain |
| 19 | chain guard |

-continued

| PARTS LIST | |
|---|---|
| 20 | worm gear shaft |
| 21 | motor shaft |
| 22 | upper front wheel |
| 23 | lower front wheel |
| 24 | upper rear wheel |
| 25 | lower rear wheel |
| 26 | upper middle wheel |
| 27 | lower middle wheel |
| 28 | upper fixed gear support |
| 29 | lower fixed gear support |
| 30 | upper pivoting gear support |
| 31 | lower pivoting gear support |
| 32 | shaft |
| 33 | shaft |
| 34 | shaft |
| 35 | gear |
| 36 | gear |
| 37 | gear |
| 38 | shaft |
| 39 | shaft |
| 40 | shaft |
| 41 | gear |
| 42 | gear |
| 43 | gear |
| 44 | sleeve |
| 45 | sleeve bore |
| 46 | opening |
| 47 | opening |
| 48 | opening |
| 49 | middle wheel plate |
| 50 | upper primary seaming roller |
| 51 | upper secondary seaming roller |
| 52 | upper final seaming roller |
| 53 | lower primary seaming roller |
| 54 | lower secondary seaming roller |
| 55 | lower final seaming roller |
| 56 | upper primary fixed roller |
| 57 | upper secondary fixed roller |
| 58 | upper final fixed roller |
| 59 | lower primary fixed roller |
| 60 | lower secondary fixed roller |
| 61 | lower final fixed roller |
| 62 | worm gear |
| 63 | worm gear |
| 64 | worm gear |
| 65 | bearing |
| 66 | bearing |
| 67 | cylindrical socket |
| 68 | cylindrical socket |
| 69 | bearing plate |
| 70 | bearing plate |
| 71 | cam lever |
| 72 | cam |
| 73 | upper link |
| 74 | lower link |
| 75 | arrow |
| 76 | curved slot |
| 77 | curved slot |
| 78 | handle |
| 79 | roof panel |
| 80 | roof panel |
| 81 | roof panel |
| 82 | seam |
| 83 | seam |
| 84 | arrow |
| 85 | eave |
| 86 | crest |
| 87 | arrow |
| 88 | cam shaft |
| 89 | opening |
| 90 | male flange |
| 91 | electrical power cable |
| 92 | button switch |
| 93 | button switch |
| 94 | handle |
| 95 | guard |
| 96 | pivot |

-continued

| PARTS LIST | |
|---|---|
| 97 | detent lock |
| 98 | arm |
| 99 | handle bracket |
| B | bolted connection |

The foregoing embodiments are presented by way of example only; the scope of the present invention is to be limited only by the following claims.

What is claimed is:

1. An apparatus for forming the seam that joins two adjacent interlocking male and female metal roof sections, comprising:

a) a frame having opposed upper and lower portions;

b) the upper and the lower portion each having a plurality of rollers that enable the frame to be frictionally engaged with each of the roof sections at the seam, including an upper set of rollers at the upper portion of the frame and a lower set of rollers at the lower portion of the frame;

c) a locking mechanism that closes a selected set of rollers to grip the seam;

d) a motor drive that rotates at least some of the rollers for transporting the frame along the roof seam during a forming of the roof seam; and e) wherein the upper set of rollers and the lower set of rollers can be selected to engage the roof seam by orienting the frame to present the selected upper or lower rollers to the roof seam.

2. The apparatus of claim 1 wherein the locking mechanism locks one set of rollers while simultaneously opening the other set of rollers.

3. The apparatus of claim 1 wherein the upper set of rollers and the lower set of rollers include opposed rollers that move toward and away from each other.

4. The apparatus of claim 1 wherein the motor drive includes an electric motor and a transmission that interfaces the electric motor with the upper set of rollers and with the lower set of rollers.

5. The apparatus of claim 1 wherein the motor drive simultaneously rotates some upper and some lower rollers.

6. An apparatus for forming the seam that joins two adjacent interlocking male and female metal roof sections, comprising:

a) a frame having opposed upper and lower portions;

b) the upper and the lower portion each having a plurality of rollers that enable the frame to be frictionally engaged with each of the roof sections at the seam, including an upper set of rollers at the upper portion of the frame and a lower set of rollers at the lower portion of the frame;

c) a locking mechanism that selectively opens and closes each set of upper and lower rollers so that either the upper or lower rollers can be closed to grip the seam;

d) a motor drive that rotates at least some of the rollers for transporting the frame along the roof seam during a forming of the roof seam; and e) wherein the upper and lower rollers can be selected to engage the roof seam by orienting the frame to present the selected upper set of rollers or lower set of rollers to the roof seam.

7. The apparatus of claim 6 wherein the locking mechanism opens one set of rollers while simultaneously closing the other set of rollers.

8. The apparatus of claim 6 wherein each set of said upper and said lower rollers includes a plurality of opposed rollers.

9. The apparatus of claim 8 wherein there are six rollers in said upper set of rollers including three pairs of opposed rollers.

10. The apparatus of claim 8 wherein there are six rollers in said lower set of rollers including three pairs of opposed rollers.

11. The apparatus of claim 3 wherein each set of said upper set of rollers and said lower set of rollers includes a plurality of opposed rollers.

12. The apparatus of claim 3 wherein there are at least six rollers in said upper set of rollers.

13. An apparatus for forming the seam that joins two adjacent interlocking male and female metal roof sections, comprising:

a) a frame having opposed upper and lower portions;

b) the upper and the lower portion each having a plurality of rollers enable the frame to be frictionally engaged with each of the roof sections at the seam, including an upper set of rollers at the upper portion of the frame and a lower set of rollers at the lower portion of the frame;

c) a locking mechanism that closes a selected set of rollers to grip the seam;

d) a drive mechanism moves the frame along the roof during a forming of the roof seam; and e) wherein the upper set of rollers and lower set of rollers can be selected to engage the roof seam by orienting the frame to present the selected upper or lower rollers to the roof seam.

14. The apparatus of claim 13 wherein the locking mechanism locks one set of rollers while simultaneously opening the other set of rollers.

15. The apparatus of claim 13 wherein the upper set of rollers and the lower set of rollers include opposed rollers that move toward and away from each other.

16. The apparatus of claim 13 wherein the drive mechanism includes an electric motor and a transmission that interfaces the electric motor with each set of rollers.

17. The apparatus of claim 13 wherein the drive mechanism simultaneously rotates some upper and some lower rollers.

18. The apparatus of claim 13 wherein each set of said upper and said lower rollers includes a plurality of opposed rollers.

19. The apparatus of claim 13 wherein there are six rollers in said upper set of rollers including three pairs of opposed rollers.

* * * * *